United States Patent [19]

Green

[11] 4,324,746

[45] Apr. 13, 1982

[54] CARBURETOR IMPROVEMENT FOR PART THROTTLE VACUUM STAGING

[75] Inventor: William A. Green, St. Charles, Mo.

[73] Assignee: ACF Industries, Inc., New York, N.Y.

[21] Appl. No.: 210,724

[22] Filed: Nov. 26, 1980

[51] Int. Cl.[3] ..... F02M 7/20

[52] U.S. Cl. ..... 261/51; 261/69 R

[58] Field of Search ..... 261/51, 69 R

[56] References Cited

U.S. PATENT DOCUMENTS

| | | | |
|---|---|---|---|
| 2,195,867 | 4/1940 | Mallory | 261/51 |
| 2,857,145 | 10/1958 | Morris | 261/69 R |
| 3,011,770 | 12/1961 | Stoltman | 261/69 R |
| 3,852,383 | 12/1974 | Seaman | 261/69 R |
| 3,899,551 | 8/1975 | Korte | 261/69 R |
| 3,940,459 | 2/1976 | Tipton et al. | 261/51 |

*Primary Examiner*—Tim R. Miles

*Attorney, Agent, or Firm*—J. Joseph Muller

[57] ABSTRACT

A carburetor improvement comprising a step-up spring (S) seat (1) attachable to a metering rod lifter (L). The step-up spring bears against the spring seat rather than against a step-up piston (P). Part throttle adjustment of the step-up piston position on the metering rod lifter does not alter the step-up spring force from that which the step-up spring is designed to exert when changes in engine vacuum occur and a throttle shaft (TS) is stationary.

2 Claims, 4 Drawing Figures

CARBURETOR IMPROVEMENT FOR PART THROTTLE VACUUM STAGING

BACKGROUND OF THE INVENTION

This invention relates to multi-barrel carburetors and, more particularly, to a carburetor improvement for improving vacuum staging of the carburetor.

U.S. Pat. No. 3,940,459 discloses a four-barrel carburetor having a push rod on which is carried a metering rod carrier arm. A fuel metering rod is attached to each end of the arm. The lower end of the push rod is contacted by a cam follower which is raised and lowered in response to rotation of a cam carried on a throttle shaft of the carburetor. The upper end of the push rod is threaded and a vacuum step-up piston is carried on the upper end of the rod. A spring bears against the lower end of the piston and pushes the piston upward when engine vacuum decreases. During qualification of carburetors of this type, the position of the piston on the push rod is adjusted to meet the carburetor fuel flow curve. Because the degree of adjustment between carburetors may vary, the tension created on the spring will vary from one carburetor to another. As a consequence, the vacuum step-up response of one carburetor during part-throttle operations may differ markedly from that of another similar carburetor.

SUMMARY OF THE INVENTION

Among the several objects of the present invention may be noted the provision of a carburetor improvement for vacuum staging during part throttle operations; the provision of such an improvement for promoting uniformity of vacuum staging operations for carburetors of the same type; the provision of such an improvement which does not interfere with existing carburetors staging operation; and the provision of such an improvement which is readily used with existing carburetor components or alternatively may be readily combined therewith.

Briefly, the improvement of the present invention comprises seating means attachable to the metering rod lifter of a carburetor. A step-up spring bears against this spring seating means rather than a step-up piston which moves a fuel metering rod during vacuum staging of the carburetor at part throttle operation. As a result, part throttle adjustment of the step-up piston position on the metering rod lifter does not alter the step-up spring force from that which the step-up spring is designed to exert when changes in engine vacuum occur during part throttle operation. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
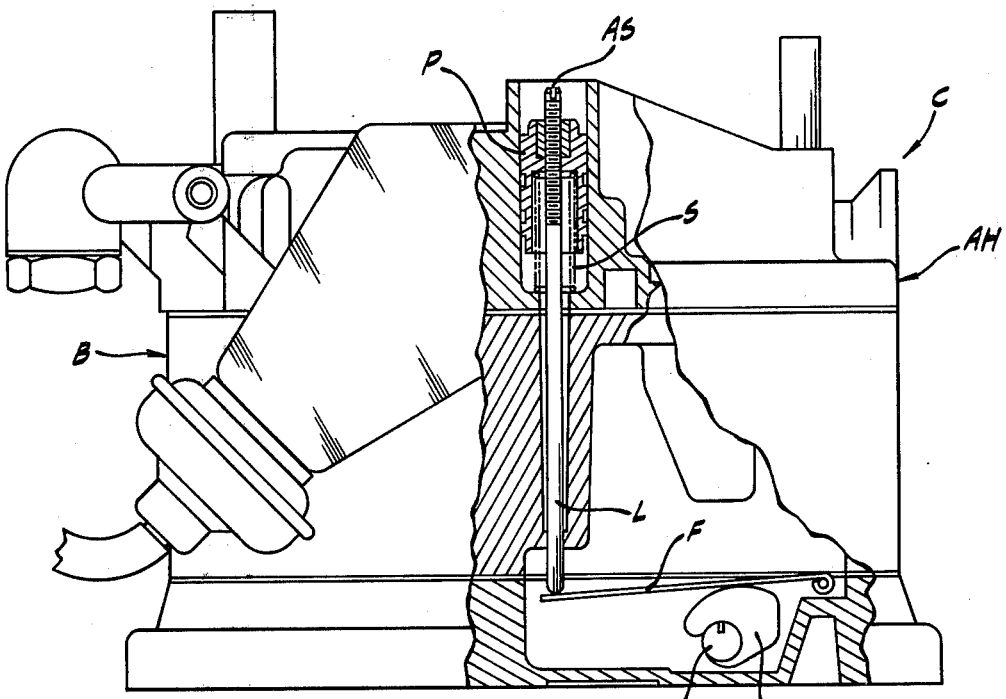
FIG. 1 is a partial elevational view, partly in section, of a carburetor, illustrating a conventional vacuum staging arrangement.

Referring to the drawings, a carburetor C for an internal combustion engine (not shown) has a fuel metering rod (also not shown). A throttle shaft TS is rotatable in the conventional manner to open and close throttle valves (not shown). A cam M is carried on the throttle shaft and a cam follower F is pivoted at one end. The undersurface of the follower rests atop the cam. The lower end of a vertically disposed metering rod lifter L seats against the distal end of cam follower F. Carburetor C is a multi-barrel carburetor and has an air horn section AH and a body section B and lifter L is installed in aligned cavities extending through these sections when the carburetor is assembled. A metering rod carriage (not shown) is attached to the upper end of the lifter.

Carburetor C has two fuel bowls (not shown) and a fuel metering rod depends from each end of the carriage into the respective fuel bowls. A step-up piston P is mounted on the upper portion of lifter L and the underside of the piston is exposed to engine vacuum. The piston is responsive to engine vacuum for moving lifter L and consequently, the fuel metering rods when a change in engine vacuum occurs while throttle shaft TS is stationary. That is, when the engine is operating at steady state conditions, any change in engine vacuum is sensed by step-up piston P which moves in response thereto. This movement is transmitted to the fuel metering rods via the lifter/carriage assembly to vary the position of the fuel metering rods in their respective fuel bowl outlets. As a consequence, the fuel supplied to the bores of the carburetor via the carburetor fuel circuits is changed an amount sufficient to return the engine to its steady state condition.

Referring to FIG. 1, step up piston P has a biasing force exerted thereon by a spring S. The force exerted on piston P by spring S balances the vacuum force on the piston. Conventionally, spring S bears against a lower surface of the piston. Any movement of step-up piston P in response to a change in engine vacuum is the result of the degree of change in vacuum and the loading force exerted by spring S.

During carburetor C manufacture, a vacuum staging check is performed to determine the response of the step-up piston to a change in vacuum. If the response does not fall within predetermined tolerances, the position of the step-up piston on lifter L is adjusted by inserting an appropriate tool in an adjustment slot AS in the top of the lifter assembly and raising or lowering the piston. This adjustment, however, changes the loading on spring S and, because of factors such as stacking tolerances, the adjustments between similar carburetors C will so vary the loading on their springs S that the loading may vary from design values. As a result, vacuum staging performance of a series of carburetors C may ultimately vary greatly from carburetor to carburetor.

Figure 2:
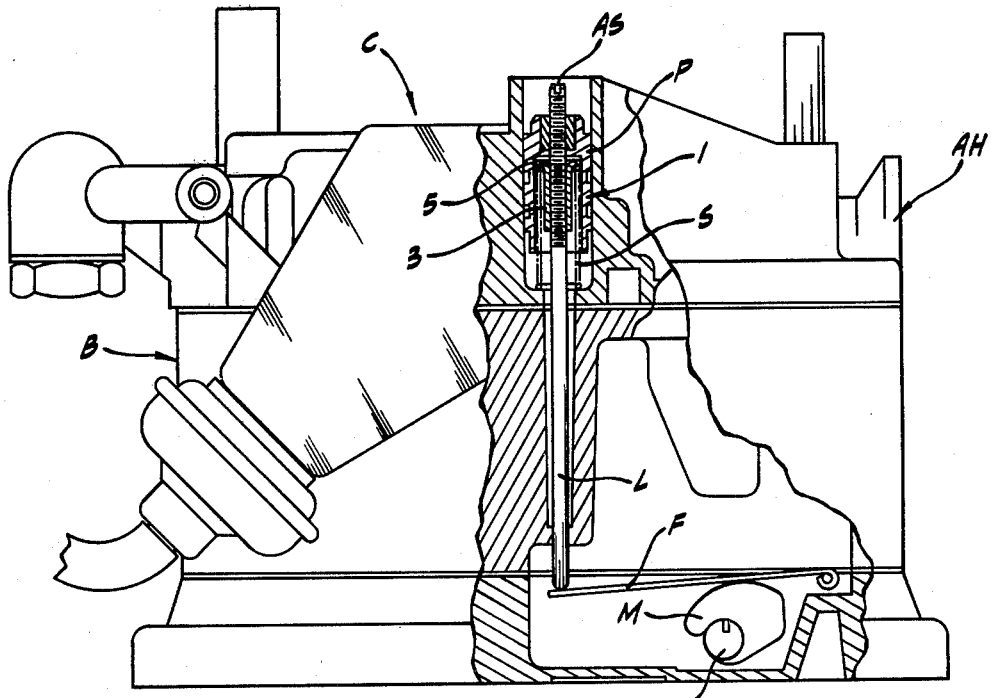
FIG. 2 is a similar view to that of FIG. 1 illustrating a first embodiment of the improvement of the present invention.
Figure 3:
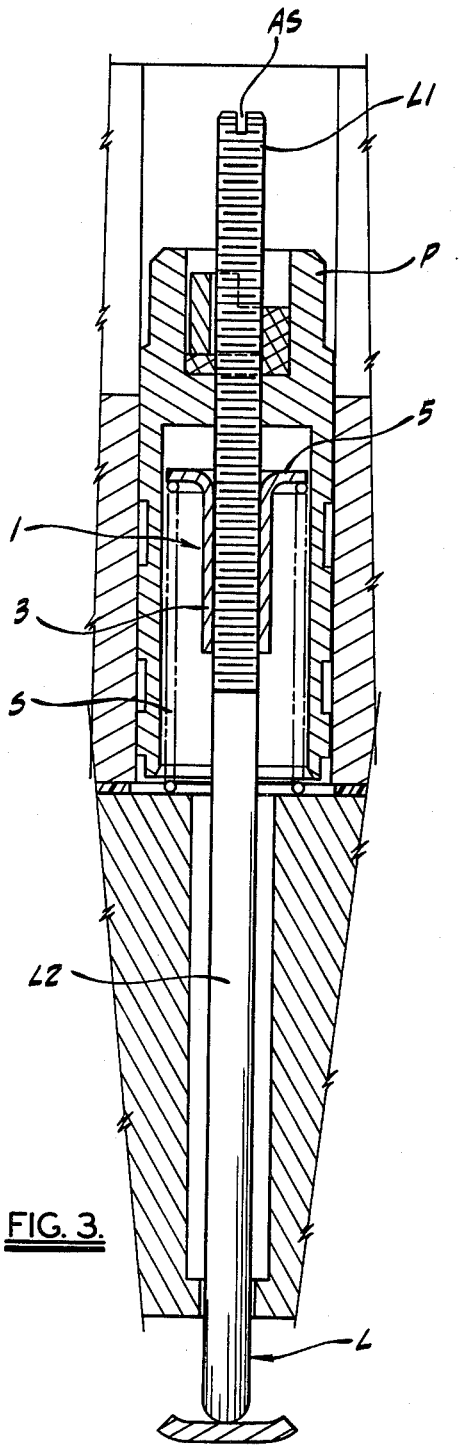
FIG. 3 is a partial sectional view of the vacuum staging mechanism of FIG. 2 further illustrating the first embodiment of the improvement of the present invention.

Referring to FIGS. 2 and 3, an improvement of the present invention is indicated generally 1 and comprises spring seating means attachable to metering rod lifter L. Means 1 comprises a sleeve 3 sized to fit over the metering rod lifter. Sleeve 3 is positioned on lifter L below piston P and is crimped in place or otherwise suitably attached to the lifter. The upper end of the sleeve is flared or turned outwardly as indicated at 5 to form a bearing surface or circumferential seat for the upper end of spring S. Now, spring S seats against sleeve 3 rather than piston P.

As shown in FIG. 3, metering rod lifter L is comprised of an upper section L1 and a lower section L2. Step-up piston P is secured to section L1 of the lifter which is threaded at its lower end and is received in a threaded bore in the upper end of lifter section L2. Sleeve 3 is secured to lower section L2 of the lifter. Now, adjustment of the piston P position (i.e. raising or lowering the piston in the air horn cavity has no effect on the loading force exerted on the piston due to spring S. Consequently, this force remains at its design value regardless of how much piston P position has to be adjusted to meet manufacturing specifications. This promotes uniformity of operation among all carburetors C.

It will be noted that implementation of the improvement of the present invention does not interfere with the way carburetor C is designed for vacuum staging and that sleeve 3 is readily used with the existing metering rod lifter without any modification to the lifter. Thus, the improvement can be implemented at slight cost and without affecting existing carburetor assembly and testing. At the same time, moreover, uniformity of operation between carburetors of the same design is improved.

Figure 4:
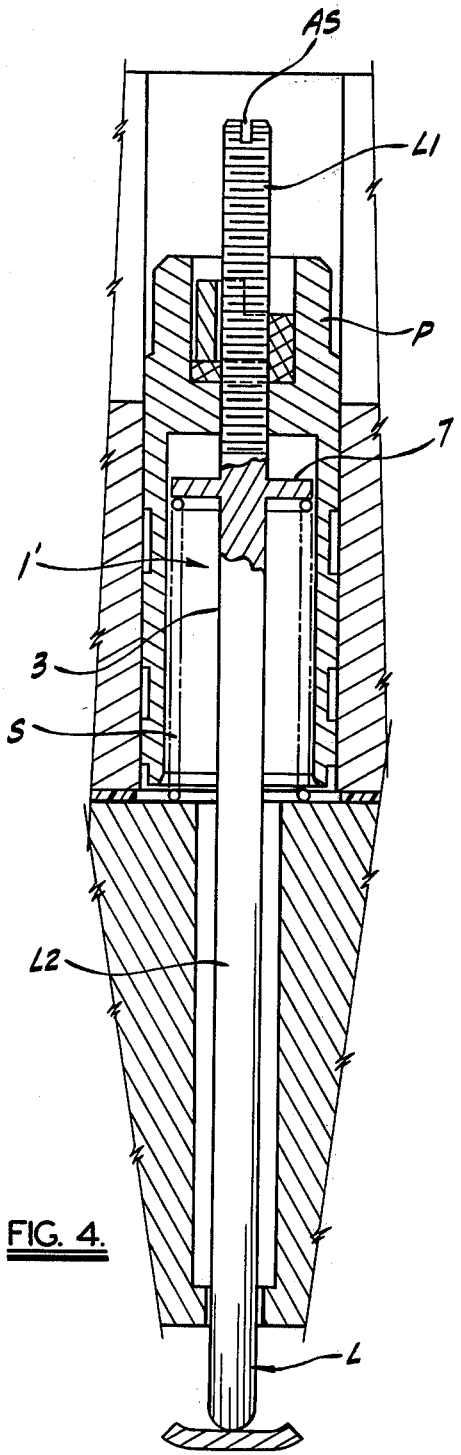
FIG. 4 is a view similar to FIG. 3 illustrating a second embodiment of the improvement of the present invention.

Referring to FIG. 4, a second embodiment of the improvement of the present invention is shown. Now, spring seating means 1' comprises a collar 7 fitting about metering rod lifter L and specifically, lower section L2 of the lifter. The upper end of spring S bears against the underside of the collar which forms a bearing surface for the spring. Collar 7 is secured to the nonadjustable section of the lifter in any suitable manner or may be integrally formed therewith.

In view of the above, it will be seen that the several objects of the invention are achieved and other advantageous results obtained.

As various changes could be made in the above constructions without departing from the scope of the invention, it is intended that all matter contained in the above description and shown in the accompanying drawing shall be interpreted as illustrative and not in a limiting sense.

What is claimed is:

1. In a carburetor for an internal combustion engine, the carburetor having a fuel metering rod, a throttle shaft, a cam carried on the throttle shaft, a cam follower movable by the cam, a metering rod lifter contacted by the cam follower for moving the metering rod as the throttle shaft rotates, a step-up piston mounted on the lifter and responsive to engine vacuum for moving the lifter and the metering rod when a change in engine vacuum occurs while the throttle shaft is stationary, the position of the step-up piston on the lifter being adjustable for part throttle carburetor operation, and a step-up spring normally bearing against the step-up piston to exert a force on the piston which balances the force exerted thereon by engine vacuum, the improvement comprising spring seating means attachable to the metering rod lifter, the spring seating means including a sleeve sized to fit over the metering rod lifter, one end of the sleeve being flared outwardly to form a circumferential seat against which the step-up spring bears, the step-up spring bearing against the circumferential seat rather than the step-up piston whereby part throttle adjustment of the step-up piston position on the metering rod lifter does not alter the step-up spring force from that which the step-up spring is designed to exert when changes in engine vacuum occur and the throttle shaft is stationary.

2. The improvement of claim 1 wherein the metering rod lifter is comprised of an upper section and a lower section, the step-up piston being secured to the upper lifter section and the sleeve being secured to the lower lifter section, the upper section of the lifter being adjustable to adjust the position of the step-up piston, adjustment of the step-up piston position not affecting the step-up spring's spring force.

* * * * *